US005607092A

United States Patent [19]

Alexander

[11] Patent Number: 5,607,092

[45] Date of Patent: Mar. 4, 1997

[54] JOINTED NEOPRENE SEGMENTS CARRYING STRAP

[75] Inventor: Thomas J. Alexander, Kokonoc Bld. No. 602, Koenji-Minami 4-28-13 Suginami-Ku, Tokyo, Japan, T166

[73] Assignee: Thomas J. Alexander, Tokyo, Japan

[21] Appl. No.: 350,825

[22] Filed: Dec. 7, 1994

[51] Int. Cl.[6] ..... A45F 3/14

[52] U.S. Cl. ..... 224/258; 224/264; 224/600; 224/643; 294/149; 294/156; 24/301

[58] Field of Search ..... 224/202, 175, 224/178, 220, 257, 258, 264, 913; 2/311, 312, 338; 602/62, 64, 74, 75; 24/3.3, 3.13, 300, 301, 302; 294/149, 153, 156

[56] References Cited

U.S. PATENT DOCUMENTS

| | | | |
|---|---|---|---|
| 2,590,616 | 3/1952 | Heller | 2/237 |
| 2,676,737 | 4/1954 | Zirbel | 224/264 |
| 2,977,601 | 4/1961 | Winston et al. | 2/237 |
| 2,999,246 | 9/1961 | Rowan | 2/237 |
| 3,435,867 | 4/1969 | Hyden . | |
| 3,672,005 | 6/1972 | Barber | 24/300 |
| 3,957,282 | 5/1976 | Finnigan | 280/744 |
| 4,550,869 | 11/1985 | Johnson | 224/264 |
| 4,747,527 | 5/1988 | Trumpower, II | 224/224 |
| 4,769,875 | 9/1988 | Hartman | 24/300 |
| 4,827,578 | 5/1989 | Heckerman et al. | 24/265 A |
| 4,860,408 | 8/1989 | Johnson | 24/300 |
| 4,879,768 | 11/1989 | McClees et al. | 224/264 |
| 4,905,879 | 3/1990 | Piccone | 224/175 |
| 4,911,156 | 3/1990 | Libertucci | 602/62 |
| 4,970,039 | 11/1990 | Long | 264/136 |
| 4,976,388 | 12/1990 | Coontz | 224/264 |
| 5,143,266 | 9/1992 | Heckerman et al. | 224/150 |
| 5,152,443 | 10/1992 | Hagan | 224/252 |
| 5,238,162 | 8/1993 | La Civita | 224/250 |
| 5,292,044 | 3/1994 | Reimers | 224/264 |
| 5,377,391 | 1/1995 | Foster | 24/301 |
| 5,431,320 | 7/1995 | Hash | 224/258 |

FOREIGN PATENT DOCUMENTS

| | | | |
|---|---|---|---|
| 12211 | 4/1933 | Australia | 2/237 |
| 2670373 | 6/1992 | France | 224/202 |
| 897536 | 11/1953 | Germany | 2/237 |
| 9109551 | 7/1991 | WIPO | 224/258 |

*Primary Examiner*—Henry J. Recla
*Assistant Examiner*—Gregory M. Vidovich
*Attorney, Agent, or Firm*—Meltzer, Lippe, Goldstein, et al.

[57] ABSTRACT

A carrying strap for carrying a load greatly minimizes a bouncing action due to the load and better distributes the stress on a shoulder or a neck supporting the strap. The strap has stretchable segments separated by a gap and connected by less stretchable or non-stretchable joints. The relatively short segments and joints prevent the strap from expanding too far or tearing when heavy loads are carried. The gaps separating the segments reduce a weight bearing surface contacting a user's shoulder and distributes the stress at the point of contact throughout the strap. In response to the load, the segments expand. This enlarges the gap which further decreases the point of contact between the segments and the shoulder. The strap also has a pad underlying the segments for cushioning the shoulder. A sleeve may be fixedly or removably attached to the segments and the pad.

20 Claims, 5 Drawing Sheets

JOINTED NEOPRENE SEGMENTS CARRYING STRAP

FIELD OF THE INVENTION

The present invention relates to a carrying strap for carrying a load. In particular, the present invention relates to a carrying strap, such as a shoulder or a neck strap, which has expandable neoprene segments separated by gaps, the segments being connected to each other by joints.

BACKGROUND OF THE INVENTION

Shoulder and neck straps are often used for carrying a load. For example, a shoulder strap could be used for carrying a golf bag or a duffel bag. Similarly, neck straps are used for carrying a variety of musical instruments such as a saxophone. Such loads are often carried for a long time. Poorly designed shoulder and neck straps become uncomfortable when carrying heavy loads for a long time. For example, rubbing the strap against a person's body for a long time may cause skin irritations. Old carrying straps were poorly designed or made of inelastic material, such as leather. Therefore, shocks or stress from carrying a load for extended periods of time while moving, e.g., during long walks, were absorbed by the body of the person carrying the load causing pain and discomfort.

Newer more comfortable straps use soft stretchable material, such as neoprene, which provides a cushioning effect and functions as a shock absorber. Neoprene distributes shocks caused by the load more uniformly. However, because a long piece of neoprene has elasticity similar to a rubber band, the object being carried bounces when a single strap of neoprene is used as a shoulder or a neck strap.

Such an excessive up and down bounce causes uncomfortable changes in the load pressure upon a person's shoulder or neck. The point where the strap comes in contact with the shoulder or the neck bears the brunt of the stress caused by the bounce. The more a person moves or the heavier the weight of the load, the larger the bouncing effect which increases shoulder or neck stress and discomfort. Therefore, the cushioning and shock absorbing effect of the neoprene is counteracted by an excessive bouncing which is very uncomfortable and inconvenient. Furthermore, under a heavy load, the overstretched neoprene will tear. To prevent excessive stretching and tearing, an additional strap is used, which is stronger and less stretchable than neoprene.

FIG. 1 shows such a conventional shoulder strap 100 having a neoprene strap 120 and an additional strap 130 which is attached to the neoprene strap 120 by stitches 140 at spaced intervals. The neoprene strap 120 is usually wider than the additional strap 130 so that the load carried by the strap 100 is distributed over a larger area. In addition, the neoprene strap 120 is usually in contact with the shoulder since it is soft and provides a cushioning effect. That is, the additional strap 130 is an upper strap.

The additional strap 130 is formed from a strong fabric such as nylon or other elastic webbing and is attached to the neoprene strap 120 to form loops 150, as shown in FIG 1*b*. Alternatively, instead of the additional strap 160, a neoprene strap 170 forms loops 180, as shown in FIG. 2. As shown in FIG. 3, when the strap 100 is stretched under a heavy load, the loops 150, 180 (FIGS. 1 and 2) become taut and the additional strap 190 carries the load. This prevents overstretching or tearing of the neoprene strap 195.

However, such straps 100 neither minimize the bouncing effect of neoprene, nor maximize distribution of the stress along the entire strap. This is particularly a problem when the carried load is heavy, or movement is involved for a long time. Examples include carrying a golf bag during a lengthy golf game, hiking on a rough terrain, long distance walking or carrying and playing a musical instrument for an extended duration while rapidly moving with the rhythm of music.

A further disadvantage of the loops 150, 160 is the ease with which the loops may inadvertently hook onto protrusions thus tearing the strap or causing the bearer of the strap to lose balance and fall. An object of the present invention is to overcome these disadvantages.

It is a further object of this invention to provide a neoprene carrying strap constructed so that the strap is strong and capable of carrying heavy loads with a minimum bounce and a maximum comfort without using loops formed between the neoprene strap and an additional strap.

Another object of the present invention is to decrease the weight bearing surface area of the neoprene strap that comes in contact with a user's shoulder or neck and reduce the stress at the points of contact between the strap and the shoulder or neck.

Yet another object of the present invention is to better distribute the weight along the strap.

SUMMARY OF THE INVENTION

These and other objects are achieved by the present invention which provides a carrying strap for carrying a load comprising a plurality of segments made from a stretchable material, and at least one joint connecting the stretchable segments to each other and disposed in a gap between the segments. For example, the inventive carrying strap may be a shoulder strap or a neck strap. The inventive carrying strap stretches under the load, with the joints being made from a material which is less stretchable than the material of the stretchable segments.

Illustratively, the segments are made from neoprene and the joints are made from latex or nylon. The latex joints may be covered with cloth. A single joint may connect two adjacent segments. This joint may be located on an upper surface or a middle surface of the segments. The middle surface is exposed by slitting the segment and pulling back a top portion.

The joints may be stretchable or non-stretchable. The gaps, which separate the segments from each other, reduce a weight bearing surface contacting a shoulder or a neck. This distributes stress on the weight bearing surface throughout the strap. When a load is carried, the neoprene segments expand thus expanding the gaps. The expanded gaps further reduce the weight bearing surface contacting the shoulder or the neck and further distributes the stress at the weight bearing surface throughout the strap.

In another embodiment, the inventive carrying strap further comprises a pad underlaying the segments for cushioning the shoulder or the neck. The pad may be made from foam rubber. The inventive carrying strap may also have a sleeve which may be made of cloth. The sleeve covers the segments and the pad. The sleeve is attached to the segments and the pad. The sleeve may be removably attached.

In yet another embodiment, the inventive carrying strap further comprises a safety strap. The safety strap is attached to end segments which are the segments located at opposite extremes of a chain made of the segments. Illustratively, the safety strap is attached to an upper surface of the end segments.

In another embodiment, the inventive carrying strap further comprises an buckle connected to one of the end segments by a pair of joints, namely, an inner joint and an outer joint. The inner joint is looped around the end buckle and attached to a middle surface of the end segment which is exposed by slitting the end segment and pulling back a top portion. The outer joint is also looped around the end buckle over the inner joint and attached to upper and lower surfaces of the end segment. A hook may also be attached to the buckle.

According to another embodiment, the carrying strap comprises a buckle and an end strap. The end strap is attached to the end segment and passes through the buckle so that a length of the end strap can be adjusted. A hook is also attached to the other end of the end strap.

In short, a carrying strap is disclosed for comfortably carrying a load despite adverse conditions such as carrying a heavy load for a long time while moving rapidly or walking for long distances. The inventive strap is flexible yet subject to less bounce than a strap using a long unbroken neoprene band. By using relatively short neoprene segments that are joined together by joints and separated by gaps several benefits emerge, namely, the relatively short neoprene segments expand less than a single long unbroken neoprene strap, thus obviating the need for an additional overlaid strap running the entire length of the neoprene to limit the neoprene's stretch. Furthermore, the joints connecting the neoprene segments, along with the neoprene segments themselves, act as shock absorbers to better dissipate the stress caused by the bouncing and the weight of the load. The up and down bouncing of the inventive strap is less than that of a strap having a long unbroken band of neoprene.

In addition, because of reduced pressure on the shoulder or neck at the gap regions, comfort is greatly increased. Moreover, when stretchable cloth bound latex joints are used, the gaps between the neoprene segment expand. This further reduces the weight bearing surface areas of the neoprene segments that contact the shoulder or the neck and adds to the shock absorbing character of the strap. Furthermore, the weight of the load is better distributed. The sensation felt by the whole strap being able to expand dissipates the stress felt at a point of contact with the shoulder or he neck; instead of a concentrated stress point contacting the shoulder or the neck, the stress is distributed throughout the strap. The inventive strap gives a general sense of lightness when carrying loads.

DETAILED DESCRIPTION OF THE INVENTION

Figure 1A:
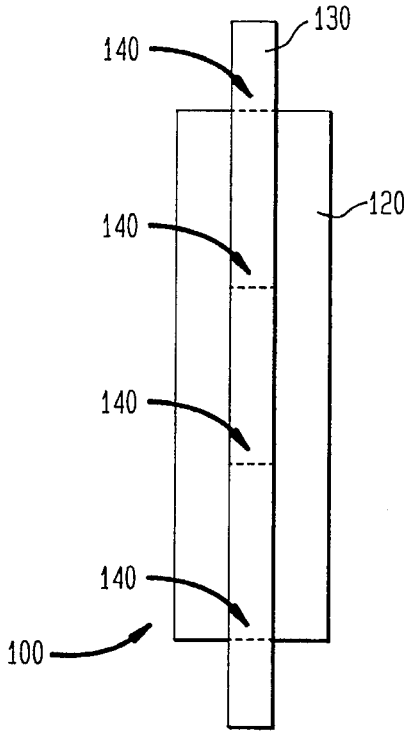
FIG. 1A (PRIOR ART)
FIG. 1*a* shows a top view of a conventional carrying strap with a neoprene strap and a reinforcing upper strap.
Figure 1B:
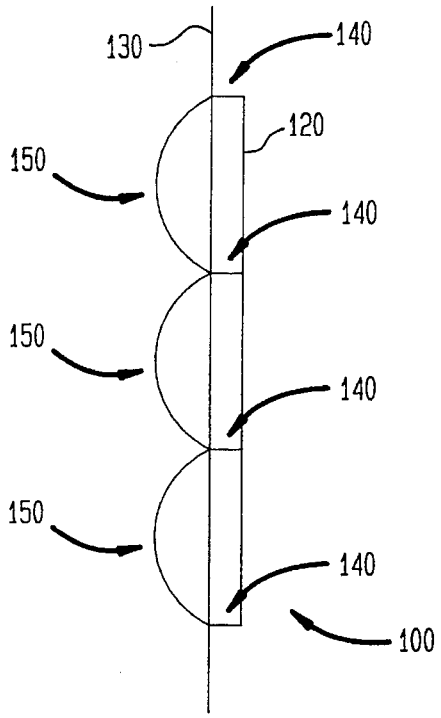
FIG. 1B (PRIOR ART)
FIG. 1*b* shows a side view of the conventional carrying strap shown in FIG. 1*a*.
Figure 2:
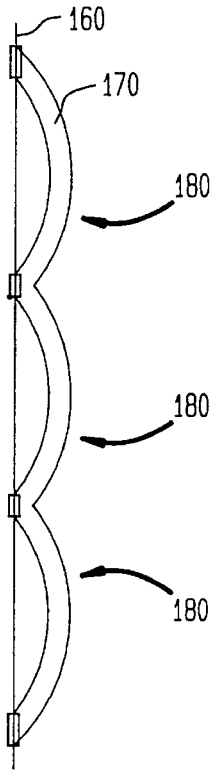
FIG. 2 (PRIOR ART)
FIG. 2 shows a side view of a different embodiment of a conventional carrying strap.
Figure 3:
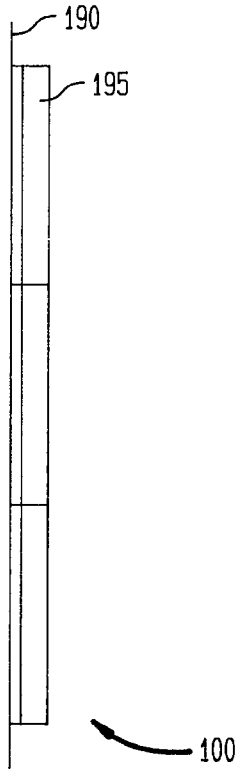
FIG. 3 (PRIOR ART)
FIG. 3 shows a side view of a conventional carrying strap in a longitudinally stretched condition.
Figure 4:
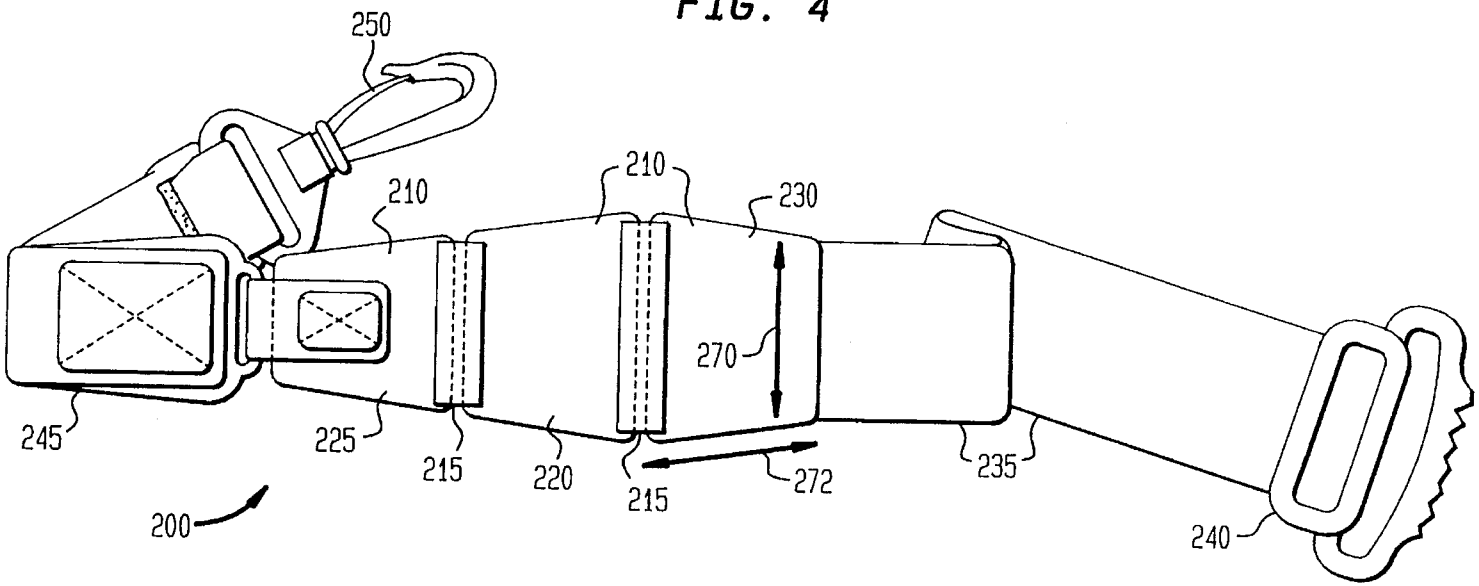
FIG. 4 shows an illustrative embodiment of a carrying strap according to the present invention.
Figure 5:
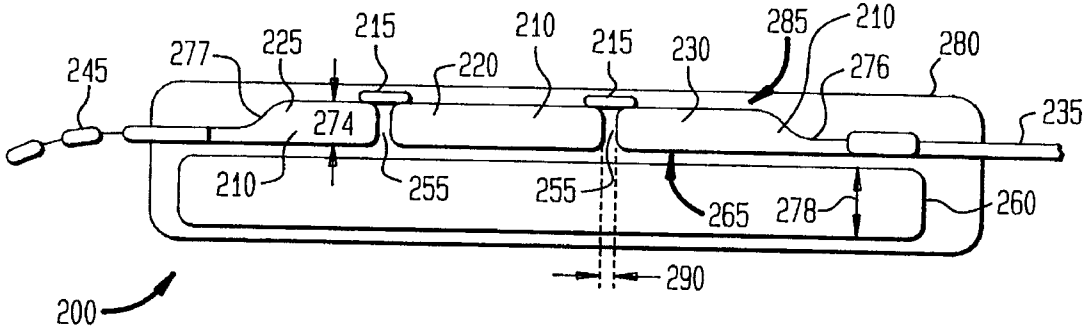
FIG. 5 shows a cross sectional side view of the carrying strap of the present invention shown in FIG. 4.

FIGS. 4 and 5 show a carrying strap 200 according to one embodiment of the present invention. For clarity, the ensuing description will be limited to a shoulder strap, however similar principles and descriptions apply for a neck strap. The strap has segments 210 connected together by joints 215. The segments 210 are made of an elastomeric material which is soft, expandable and resilient. Illustratively, the segments 210 are neoprene segments. The flexibility of the neoprene segments 210 provide for stretchability of the carrying strap 200 and increased comfort while carrying a load. Other expandable material may be substituted for neoprene, depending on the weight of the carried load. For illustration purposes, the carrying strap 200 has three segments 210, namely, a middle segment 220 and two end segments 225, 230.

The connecting joints 215 are made of a material which is stronger and relatively inelastic or less elastic than the neoprene segments 210. Illustratively, the connecting joints 215 are made of latex which may be covered with cloth. The cloth bound latex joints have a slight stretchability. Preferably, the connecting joints 215 are made of durable nylon having a minimum or no stretchability.

The non-stretchable joints have at least two advantages, namely, increasing the sturdiness of the carrying strap 200 and absorbing more shock, thus acting as better shock absorbers than stretchable joints. The joints 215 may be covered with a decorative cloth for example, which adds to the joints' strength and enhances their appearance. Instead of being covered with a cloth (not shown), the joints 215 may themselves be made of durable, relatively inelastic and decorative cloth. Illustratively, the joints 215 may by glued and/or stitched to the neoprene segments 210. Heavy duty durable nylon threads may be used for stitching to insure durability.

Illustratively, at one end, the carrying strap 200 has an adjustable end strap 235 attached to one end of the neoprene end segment 230. The adjustable end strap 235 may be inelastic nylon or other durable material with no elasticity. The nylon strap 235 is inserted through a buckle 240 which is used to adjust the length of the nylon strap 235. A second end strap 245 is attached to one end of the other neoprene end segment 225 and is made of similar material as the adjustable end strap 235. The second end strap 245 may be unadjustable. Alternatively both end straps 240 and 245 may be adjustable or nonadjustable. The carrying strap 200 terminates at both ends with hooks 250 (only one hook is shown in FIG. 4). The hooks 250 may be attached to a load that has connecting rings, so that the strap can easily be hooked and unhooked from the load.

FIG. 5 is a side view of the carrying strap 200 of FIG. 4 showing the neoprene segments 210 separated by a gap 255. The gaps 255 reduce a weight bearing surface area contacting a shoulder (or contacting a neck in the case of using a neck strap). A soft pad 260 is located longitudinally below (i.e., on a lower surface 265 of) the neoprene segments 210 in a parallel relation thereto. The pad 260 is relatively thick and is softer than the neoprene segments 210. The pad 260 extends along the entire length and width of the neoprene segments 210.

When the carrying strap 200 is used, the pad 260 is located between a user's shoulder and the neoprene segments 210. Since the pad 260 is softer than neoprene, the pad 260 has a dual effect of both further cushioning the shoulder from bounce, and providing a feeling of comfort which surpasses the use of neoprene segments alone. The additional cushioning and comfort provided by the pad 260 is beneficial particularly under a heavy load or when the person carrying the load is moving rapidly, walking for an extended period of time or hiking on a rough terrain. Illustratively, the soft pad 260 is made from a foam rubber pad.

In the embodiment of FIGS. 4 and 5, three neoprene segments 210 are shown for illustrative purposes. However, the number, size and thickness of the neoprene segments 210 may be changed depending on the weight of the carried load and other conditions, such as the movement of the user. For example, when carrying heavier objects, the whole strap extends to its maximum capacity and will not expand further. Thus, a feeling of lightness, normally resulting from the expansion of the strap, will no longer be enhanced. This problem is alleviated by using a strap having additional neoprene segments for carrying the heavier loads, so that the stretch capacity of the strap is increased. Alternatively, for carrying heavy loads, the size and thickness of the neoprene segments 210 may be changed (e.g., the size decreased and the thickness increased).

Illustratively, the neoprene segments 210 are square segments ranging in dimension from 40 mm by 40 mm to 100 mm by 100 mm. That is, the neoprene segments 210 have a side 270, 272 (FIG. 4) ranging approximately from 40 mm (millimeters) to 100 mm. The neoprene segments 210 have a thickness 274 ranging approximately from 5 to 15 mm. Illustratively, for carrying light loads, the ends 276, 277 of the neoprene end segments 225, 230 which are attached to the end straps 235, 245 have a reduced thickness to better match the thickness of the end straps 235, 245. However, for heavy loads, it is preferable that the ends 276, 277, which are at a relatively high stress point, have the same thickness as the rest of the neoprene segments in order to prevent weakening of the strap.

Figure 6:
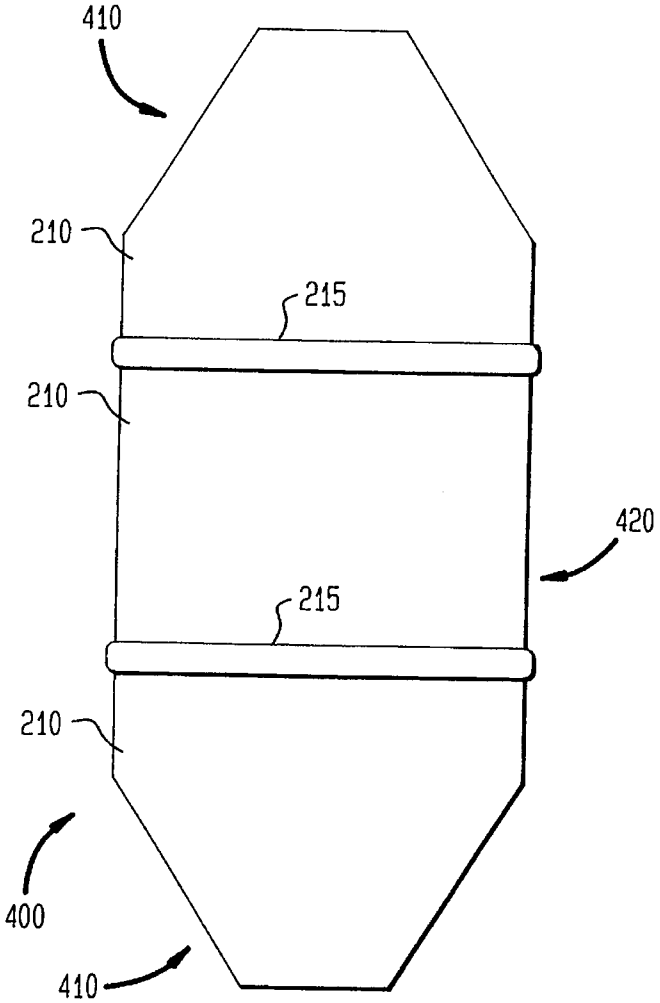
FIG. 6 shows a top view of another embodiment of the carrying strap of the present invention.

The rubber pad 260 has a thickness 278 ranging approximately from 10 mm to 40 mm. The rubber pad 260 is rectangular in shape matching the rectangular shape of the connected neoprene segments 210. Alternatively, the rubber pad 260, along with the connected neoprene segments 210, have a narrower width at both ends 410 and a wider middle portion 420 relative to their ends 410 as shown in a top view of the carrying strap 400 of FIG. 6.

FIG. 5 also shows a sleeve 280 which encloses the neoprene pads 210, the connecting joints 215 and the pad 260. The sleeve 280 is made of soft but durable material that provides a comfortable surface to the wearer. The sleeve 280 may be nylon, however a cloth sleeve is preferable since it is more comfortable. It may be used as a decorative sleeve and/or as a reinforcing sleeve. The sleeve 280 is not indispensable to the operation of the device but provides an improved appearance. The neoprene segments move freely within the sleeve 280. The sleeve 280 may be permanently attached or temporarily attached so that it may be removed and cleaned, e.g., washed.

In the embodiment shown in FIG. 5, the connecting latex joints 215 are located on an upper surface 285 of the neoprene segments 210 opposite the pad 260. Alternatively, the joints 215 may be attached to the lower surface 265 or a middle surface between the upper surface 285 and the lower surface 265 of the neoprene segments 210. Attaching the joint 215 to the middle surface is accomplished by slitting the neoprene segment 210 along its thickness at its end, pulling back a top half of the segment 210, and attaching the joint to the middle surface in the slitted section. (A detailed explanation is given below in connection with FIG. 9*b*).

Because the neoprene segments 210 are relatively short, they stretch less than a single neoprene strap having a length equaling the overall length of the connected neoprene segments 210. Therefore, the strap 200 stretches and bounces less under a heavy load compared with a strap of equal length having a single neoprene strap instead of several neoprene segments.

Figure 7:
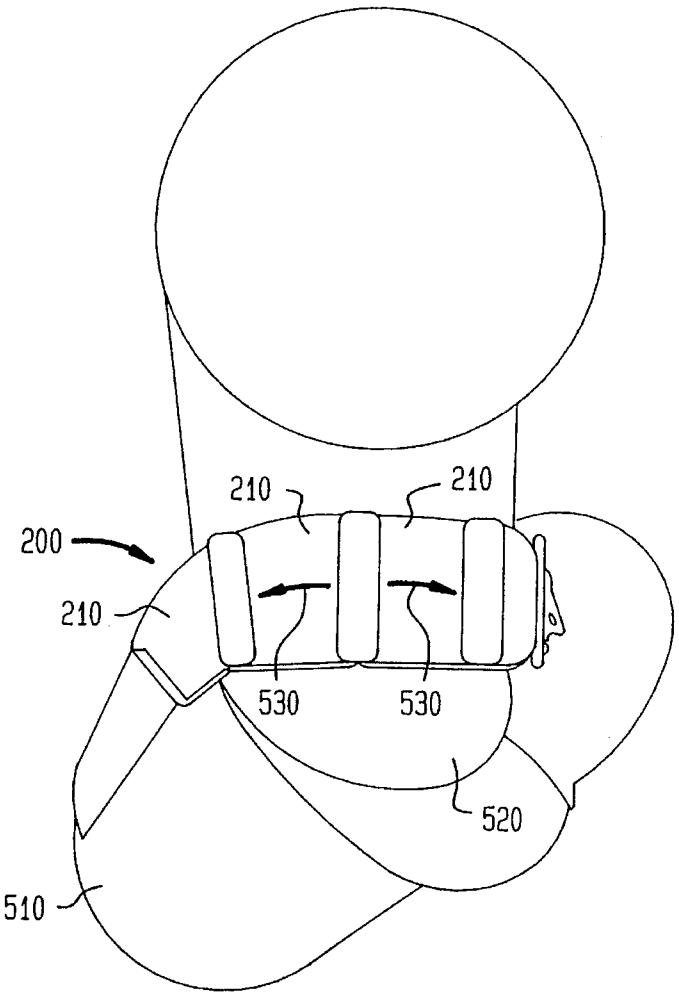
FIG. 7 shows a top view of the carrying strap of the present invention shown in FIG. 4 supported on a shoulder of a user carrying a load.

FIG. 7 shows the carrying strap 200 supporting a load 510 as worn on a carrying 520 of a person. Arrows 530 show the direction of stretch of the neoprene segments 210 due to the weight of the load 510.

Figure 8:
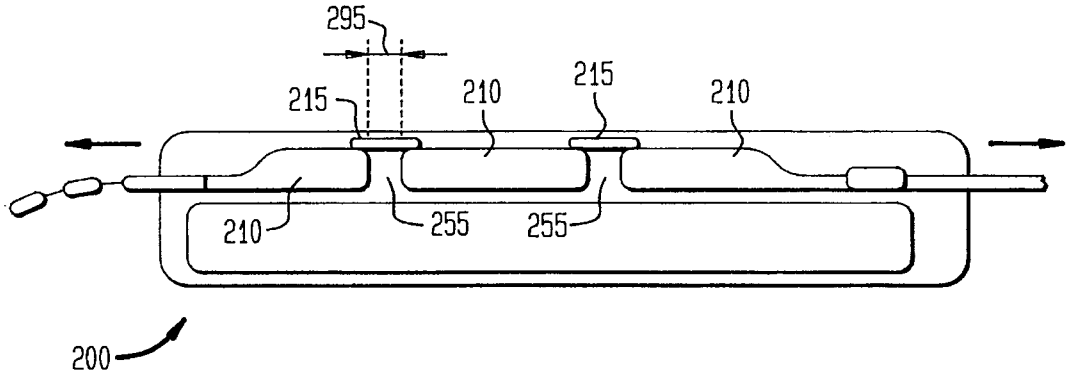
FIG. 8 shows a cross sectional side view of the carrying strap of the present invention shown in FIG. 4 in a longitudinally stretched condition.

FIG. 8 shows the carrying strap 200 in a stretched condition simulating the effect of a load carried by the strap 200. In the stretched condition, the neoprene segments 210 expand thus expanding the gaps 255. Furthermore, when the joints 215 are made of stretchable material, such as latex which may be cloth bound, both the segments 210 and the latex joints 215 expand, thereby further expanding the gaps 255. However, the stretchable joints 215 stretch only slightly. Thus, the expansion of the gaps 255 is primarily due to the neoprene segments 210. Larger or thinner neoprene segments 210 stretch more, further expanding the gaps 255. However, for heavy loads, thicker and shorter neoprene segments 210 are used.

The expanded gaps 255 further reduce a weight bearing surface area which contacts a shoulder. This further distributes the stress on the shoulder through the elasticity of the strap 200. The gaps 255 are approximately from 3 mm to 5 mm in length 290 (FIG. 5) in a relaxed position of the strap 200, and are approximately from 10 mm to 30 mm in length 295 (FIG. 8) in the stretched position.

The carrying strap 200 has been described above using three neoprene segments 210 and a single joint 215 connecting two adjacent neoprene segments 210. The joint 215 is located on the upper surface 285 (FIG. 5) of the neoprene segments 210. Alternatively, the joint 215 may be located on the lower surface 265 (FIG. 5) or in the middle of the neoprene segments 210. For example, the neoprene segments may be slitted at their ends, and the joints attached therein. The joints may be stitched and/or glued in the middle of the neoprene segments 210. For example, contact cement is used for gluing. Other attachment means may also be used.

Figure 9A:
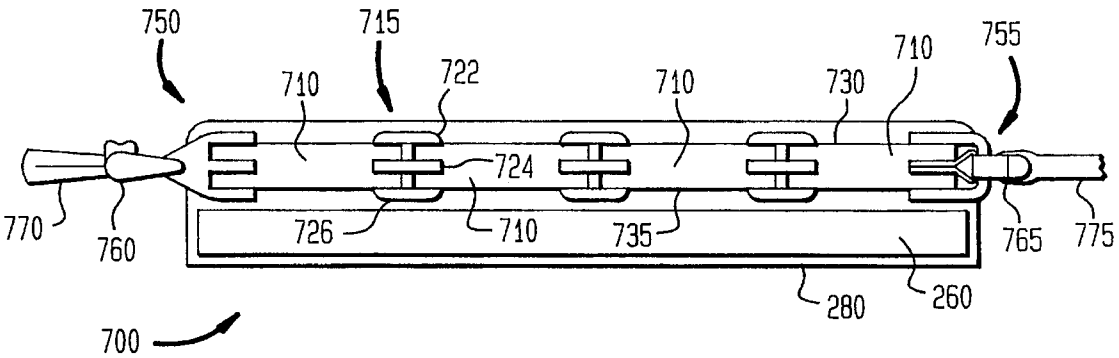
FIG. 9*a* shows a cross sectional side view of another embodiment of the carrying strap of the present invention.

FIG. 9*a* shows an alternative carrying strap 700 having four neoprene segments 710. In addition, three joints 722, 724, 726 connect two adjacent neoprene segments 710. The joints 722, 724, 726 connecting the segments 710 are the points of great stress in the strap. Thus, connecting the segments 710 with more than one joint, provides a significant reinforcement to the strap at points of high stress. This greatly increases the load carrying capability of the strap 700. As already mentioned with respect to varying the number of segments 710 (210 of FIG. 4), the number of joints may also be varied depending on the load carrying specification of the inventive strap.

FIG. 9*a* is a cross sectional view of the carrying strap 700, with the segments 710 being joined together with three joints; a top joint 722, a middle joint 724 and a bottom joint 726. The top joints 722 are attached to the upper surfaces 730 of segments 710. The bottom joints 726 are attached to the lower surfaces 735 of segments 710. The top and bottom joints 722, 726 are attached in a similar fashion described in connection with the embodiment shown in FIGS. 4–8. That is, the joints 722, 726 are glued and/or stitched using durable thread to the respective surfaces 730, 735 of the segments 710.

Figure 9B:
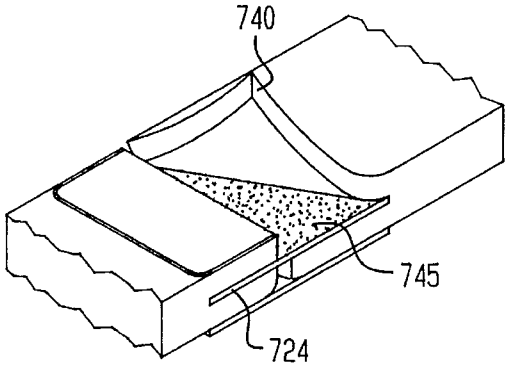
FIG. 9*b* shows the connection between two segments of the carrying strap shown in FIG. 9*a* in greater detail.

To attach the middle joint 724, the segment 710 is slitted in the middle as shown FIG. 9*b*. The slit may separate the segment 710 into two thinner segments so that the middle joint 724 is located, e.g. glued or stitched, between the two thin segments. A top half 740 of the segment 710 is pulled back exposing a middle surface 745. The middle joint 724 is placed on the middle surface 745 of the segment 710. Thereafter, the middle joint 724 is glued and/or stitched to the middle surface 745 in a similar fashion as the top and bottom joints 722, 726. The attached middle joint 724 is now covered by the top half 740 of the segment 710. The top half 740 is attached to the middle joint 724 by gluing and/or stitching so that the middle joint 724 is secured between the top half 740 and the middle surface 745.

Illustratively, each endpoint 750, 755 of segments 710 located at the extremities of a chain formed by the connected segments 710 is attached to buckles 760, 765 respectively. At the endpoint 750, the buckle 760 is attached to a hook 770, while at the other endpoint 755, the buckle 765 is attached to an end strap 775.

Figure 10:
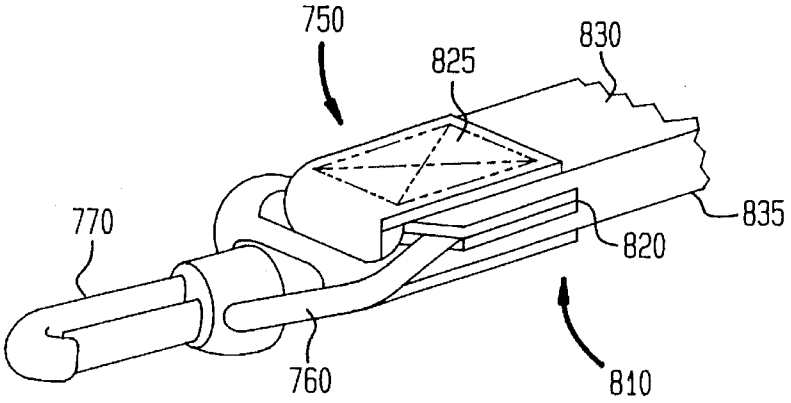
FIG. 10 shows the connection between an end segment and a buckle of the carrying strap shown in FIG. 9*a*.

FIG. 10 shows in greater detail the endpoint 750 of a neoprene segment 810 attached to the buckle 760 via an inner joint 820 and an outer joint 825. The joints 820 and 825 are preferably durable inelastic nylon but may be slightly elastic cloth bound latex similar to the joints 215, 715 of FIGS. 4 and 9 respectively.

The segment 810 is slitted in the middle and a top half pulled back in a similar fashion as explained in connection with FIG. 9*b*. A first end of the inner joint 820 is attached (e.g., glued and/or stitched) in the slitted middle section of the segment 810. The other end of the inner joint 820 is looped around the buckle 760, inserted in the slitted middle section of the segment 810 and attached to the pre-attached first end of the inner joint 820. The attached both ends of the inner joint 820 are covered by the top half of the segment 810.

One end of the outer joint 825 is attached to an upper surface 830 of the neoprene segment 810. The other end of the outer joint 825 is looped around the buckle 760 over the inner joint 820 and attached to an lower surface 835 of the neoprene segment 810.

Thereafter, all four layers formed by the looped outer and inner joints 820, 825, are stitched together between the upper 830 and lower 835 surfaces of the segment 810. A durable thread, such as a nylon threads may be used for stitching. This gives additional support and provides a strong anchor to the strap end, which is also a high stress point of the strap.

Illustratively, instead of attaching the ends of inner and outer joints 820, 825 to the segment 810, the ends are merely placed on the respective surfaces of the segment 810 for later simultaneous stitching through all four layers of the joints 820, 825, between the upper 830 and lower 835 surfaces of the segment 810.

Figure 11:
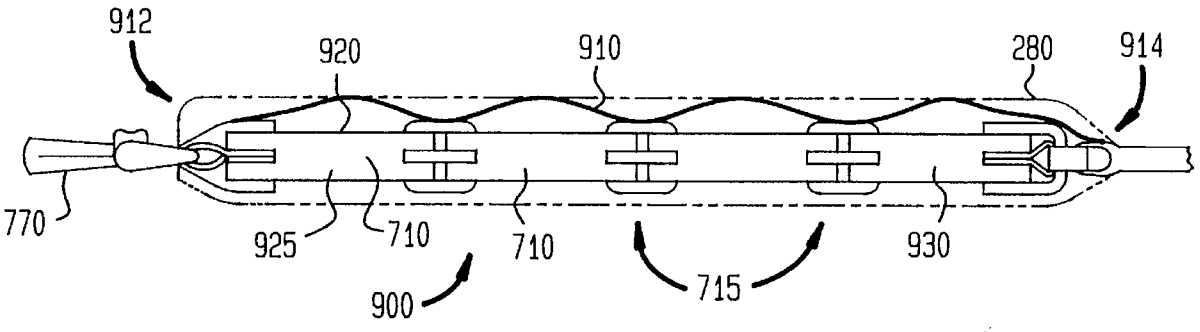
FIG. 11 shows a cross sectional side view of a third embodiment of the carrying strap of the present invention.

FIG. 11 shows a carrying strap 900 according to a third embodiment of the present invention wherein a safety strap 910 is attached to both ends 912, 914 of the chain made of the segments 710. The safety strap 910 is longer than the chain of segments 710 and rests loosely within the sleeve 280. The safety strap 910 keeps the strap together in case the segments 710 or the joints 715 break. This prevents the strap from breaking and separating into two pieces thus preventing a load being carried, such as an infant, from dropping. The safety strap 910 is made of durable material such as nylon and is stitched to an upper surface 920 of end segments 925 and 930 located at the extremities of the chain of segments 710. Preferably, the safety strap 910 is inelastic. It has no function when the carrying strap 900 is used to carry a load weighing less than or an equal a maximum specified limit. However, when the weight of the carried load exceeds the specified limit and the length of the stretched chain of segments 710 equals the length of the safety strap 910, then the safety strap 910 becomes taut and prevents the carrying strap 900 from stretching further. Thus, the safety strap 910 prevents the chain of segments 710 from stretching beyond a maximum safe length and prevents breakage of the chain.

Alternatively, the safety strap 910 is long enough not to interfere with the stretching of the chain of segments 710. Instead, the safety strap 910 prevents breakage of the carrying strap 900 when the chain of segments 710 has broken. This prevents the carried load from dropping.

The inventive strap can be used to carry bags of all sorts. For example, musical instrument cases, golf bags, camera bags accessories, sports bags, airline carry on bags, military duffel bags, postal carriers bags, knapsacks, infant harnesses, musical instrument shoulder and neck straps and accessory bags.

In summary, a carrying strap is disclosed which is flexible, subject to less bounce than straps having a single long unbroken neoprene band, and provides more comfort to the wearer when bearing heavy loads. The inventive carrying strap better dissipate stress and distributes weight of the load. The carrying strap includes several resilient segments, e.g., neoprene segments separated by a gap and connected by one or more joints which are less resilient and stronger than neoprene. In addition, the segments are backed by a pad which is softer than the segments, e.g., foam rubber pad. A sleeve made of a strong fabric for example, with decorative features, covers the area of the strap that stretches (i.e., the segments, pads and joints) without interfering with the stretching.

With the shock absorbing effects of the joints and the neoprene segments separated by the gaps there is a reduction of bounce. Furthermore, the reduced weight bearing area contacting a shoulder due to the gaps and the softness of the foam rubber pad cause the user to experience a sensation of increasing comfort and a lessening of weight stress, especially when the load is heavy and is carried for long periods of time.

Finally, the invention has been described above with reference to illustrative embodiments. Those having ordinary skill in the art may devise numerous other embodiments without departing from the spirit and scope of the following claims.

I claim:

1. A carrying strap for carrying a load comprising:

a first end, a second end located opposite said first end, said first and second ends being attachable to said load, and an intermediate portion located between said first and second ends, said intermediate portion comprising:

segments made from a stretchable material, each segment being separated from an adjacent segment by a gap, a cushioning pad underlaying at least one of said segments, a sleeve covering said segments and said pad, and at least one joint connecting adjacent segments, and being disposed in each gap between said adjacent segments, said joint being made from a material which is less stretchable than the material of said segments, wherein each of said segments has a length which is shorter than a length of said intermediate portion, said segments being connected so that a combined length of said connected segments is approximately equal to the length of said intermediate portion, wherein said connected segments are configured so that the length of said intermediate portion expands under said load.

2. The carrying strap of claim 1, wherein said segments comprise at least three segments.

3. The carrying strap of claim 1 wherein said segments are made from neoprene.

4. The carrying strap of claim 1 wherein said at least one joint is made from latex.

5. The carrying strap of claim 4 wherein said at least one latex joint is covered with cloth.

6. The carrying strap of claim 1 wherein said at least one joint is made from nylon.

7. The carrying strap of claim 1 wherein said at least one joint is attached to upper surfaces of said segments, said upper surfaces facing away from a shoulder on which said carrying strap is carried.

8. The carrying strap of claim 1 wherein said at least one joint is attached to middle surfaces of said segments.

9. The carrying strap of claim 1 wherein said pad is made from foam rubber.

10. The carrying strap of claim 1 wherein said sleeve is made from cloth.

11. The carrying strap of claim 1 wherein said sleeve is attached to said segments and said pad.

12. The carrying strap of claim 1 wherein said sleeve is removably attached to said segments and said pad.

13. The carrying strap of claim 1 located at opposite extremes of a chain of said segments are end segments, and wherein said carrying strap further comprises a safety strap attached to each of said end segments.

14. The carrying strap of claim 13 wherein said safety strap is attached to upper surfaces of said end segments, said upper surfaces facing away from a shoulder on which said carrying strap is carried.

15. The carrying strap of claim 1 wherein said segments located at opposite extremes of a chain of said segments are end segments, and wherein said carrying strap further comprises:

a buckle, an end strap having one end attached to one of said end segments and passing through said buckle so that a length of said end strap is adjusted, and a hook attached to a second end of said end strap.

16. The carrying strap of claim 1 wherein said carrying strap is a neck strap.

17. The carrying strap of claim 1 wherein said carrying strap is a shoulder strap.

18. The carrying strap of claim 1, wherein the gaps are configured to be along a width of the intermediate portion.

19. The carrying strap of claim 1, wherein the gaps are configured to be transverse to a direction of stretch of said intermediate portion.

20. The carrying strap of claim 1, wherein one of said segments comprises two thin segments, and wherein one of said joints is located between said thin segments.

* * * * *